US010786705B2

(12) United States Patent
Davis et al.

(10) Patent No.: US 10,786,705 B2
(45) Date of Patent: Sep. 29, 2020

(54) EXERCISE MACHINES FOR LEG STRENGTHENING

(71) Applicant: Brunswick Corporation, Mettawa, IL (US)

(72) Inventors: Charles E. Davis, Fridley, MN (US); Jeremy L. Fink, Anoka, MN (US); Adam D. Keskey, Big Lake, MN (US)

(73) Assignee: Life Fitness, LLC, Rosemont, IL (US)

( * ) Notice: Subject to any disclaimer, the term of this patent is extended or adjusted under 35 U.S.C. 154(b) by 61 days.

(21) Appl. No.: 16/143,975

(22) Filed: Sep. 27, 2018

(65) Prior Publication Data

US 2020/0101348 A1 Apr. 2, 2020

(51) Int. Cl.

| | |
|---|---|
| ***A63B 23/04*** | (2006.01) |
| ***A63B 21/062*** | (2006.01) |
| ***A63B 21/00*** | (2006.01) |
| ***A63B 21/06*** | (2006.01) |
| ***A63B 23/035*** | (2006.01) |

(52) U.S. Cl.

CPC ..... *A63B 23/0482* (2013.01); *A63B 21/0615* (2013.01); *A63B 21/0622* (2015.10); *A63B 21/0632* (2015.10); *A63B 21/154* (2013.01); *A63B 21/4033* (2015.10); *A63B 21/4039* (2015.10); *A63B 23/03508* (2013.01); *A63B 2208/0209* (2013.01); *A63B 2225/093* (2013.01)

(58) Field of Classification Search

CPC ..... A63B 23/0482; A63B 23/03508; A63B 21/154; A63B 21/0615; A63B 21/0622; A63B 21/4039; A63B 21/4033; A63B 21/0632; A63B 2225/093; A63B 2208/0209

See application file for complete search history.

(56) References Cited

U.S. PATENT DOCUMENTS 4,247,098 A * 1/1981 Brentham ..... A63B 23/03525 482/112
4,575,077 A * 3/1986 Osborne ..... A63B 23/00 482/137
4,621,807 A * 11/1986 Stramer ..... A63B 21/06 482/100

(Continued)

FOREIGN PATENT DOCUMENTS

| | | |
|---|---|---|
| DE | 102013002995 | 8/2013 |
| WO | 2016105506 | 6/2016 |

OTHER PUBLICATIONS

Extended European Search Report for European Patent Application No. 19199582.8, dated Feb. 12, 2020.

*Primary Examiner* — Loan B Jimenez
*Assistant Examiner* — Catrina A Letterman
(74) *Attorney, Agent, or Firm* — Andrus Intellectual Property Law, LLP

(57) ABSTRACT

An exercise machine for leg strengthening, the exercise machine comprising a stationary frame; and a thigh support member and an ankle support member coupled to the frame and configured to support a user's thigh and ankle, respectively, during a hamstring curl exercise motion. The thigh support member and the ankle support member are each movable with respect to the stationary frame during the hamstring curl exercise motion, thus facilitating contraction and extension of both of a hamstring and glute of the user during the hamstring curl exercise motion.

31 Claims, 9 Drawing Sheets

(56) References Cited

U.S. PATENT DOCUMENTS 5,062,633 A * 11/1991 Engel ..... A63B 21/015 482/118
5,066,003 A 11/1991 Jones
5,277,684 A * 1/1994 Harris ..... A63B 21/4047 482/121
5,308,304 A * 5/1994 Habing ..... A63B 21/0628 482/100
5,336,149 A * 8/1994 Wang ..... A63B 23/0211 482/100
5,338,274 A * 8/1994 Jones ..... A63B 21/0615 482/100
5,792,027 A * 8/1998 Gvoich ..... A63B 22/001 482/51
6,152,859 A * 11/2000 Stearns ..... A63B 22/0007 482/52
6,319,178 B1 * 11/2001 Webber ..... A63B 21/154 482/100
6,558,303 B1 * 5/2003 Ellis ..... A63B 23/0494 482/100
6,676,574 B1 * 1/2004 Prokop ..... A63B 21/0615 482/100
7,476,186 B1 * 1/2009 Steffee ..... A63B 23/0482 108/144.11
9,272,180 B2 * 3/2016 Eschenbach ..... A63B 22/0056
9,604,090 B1 3/2017 Meyer et al.
10,046,197 B2 * 8/2018 Gordon ..... A63B 22/0017
2001/0053734 A1 * 12/2001 Lapcevic ..... A63B 21/0552 482/134
2007/0037667 A1 * 2/2007 Gordon ..... A63B 21/155 482/51
2008/0070756 A1 * 3/2008 Chu ..... A63B 22/02 482/54
2010/0120590 A1 5/2010 Inaizumi
2011/0218083 A1 * 9/2011 Staff ..... A63B 21/0628 482/99
2014/0364285 A1 * 12/2014 Moschel ..... A63B 21/062 482/98

* cited by examiner

EXERCISE MACHINES FOR LEG STRENGTHENING

FIELD

The present disclosure relates to exercise machines for leg strengthening, and particularly to exercise machines for strengthening a user's leg muscles, including but not limited to the user's hamstring muscles.

BACKGROUND

Conventional exercise machines for strengthening the hamstring muscles include machines where the user's hip angle remains fixed, for example seated leg curl machines, lying leg curl machines, kneeling leg curl machines, and variations thereof.

The following U.S. patents are incorporated herein by reference:

U.S. Pat. No. 9,604,090 discloses a weight stack assembly for an exercise apparatus. The weight stack assembly comprises a plurality of primary weights and a plurality of secondary weights that are located next to the plurality of primary weights. A head plate is on the plurality of primary weights. A primary weight selector mechanism is on the head plate and is configured to couple a user force receiving member to one or more of the plurality of primary weights. A secondary weight selector mechanism is on the head plate and is configured to couple the head plate to a first secondary weight in the plurality of secondary weights, and to couple the head plate to a second secondary weight in the plurality of secondary weights. The secondary weight selector mechanism is configured to engage with the first secondary weight so that the first secondary weight remains balanced in the horizontal direction when a force is applied to the user force receiving member. The secondary weight selector mechanism is further configured to engage with the second secondary weight so that the first and second secondary weights remain balanced in the horizontal direction when the force is applied to user force receiving member.

U.S. Pat. No. 6,676,574 discloses an adjustment system for positioning a pad on a user arm for an exercise machine. The user arm is coupled to a rotating cam which is attached to one end of a cable. The other end of the cable is attached to a weight system which pulls the rotating cam to bias the user arm in one position. The adjustment system has a selector hub mounted on one end of the user arm. The selector hub has an arcuate surface having a plurality of holes. A pull pin assembly is rotatably positioned around the selector hub. The pull pin assembly includes a pin which may be inserted in the plurality of holes to lock the pin assembly in a fixed position. A linkage bar has one end pivotably mounted to the pull pin assembly and an opposite end pivotably attached to one end of a support linkage bar. The support linkage bar is rotatably mounted on the user arm. The opposite end of the support linkage bar is coupled to a perpendicular rod with a pad. The perpendicular rod and pad are fixed in position relative to the user arm when the pin is inserted in one of the plurality of holes.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

In certain non-limiting examples, an exercise machine is for leg strengthening. The exercise machine has a stationary frame; and a thigh support member and an ankle support member coupled to the frame and configured to support a user's thigh and ankle, respectively, during a hamstring curl exercise motion. The thigh support member and the ankle support member are each movable with respect to the stationary frame during the hamstring curl exercise motion, thus facilitating contraction and extension of both of a hamstring and glute of the user during the hamstring curl exercise motion.

BRIEF DESCRIPTION OF THE DRAWINGS

The present disclosure is described with reference to the following Figures. The same numbers are used throughout the Figures to reference like features and like components. Unless otherwise specifically noted, articles depicted in the drawings are not necessarily drawn to scale.

DETAILED DESCRIPTION

Figure 1:
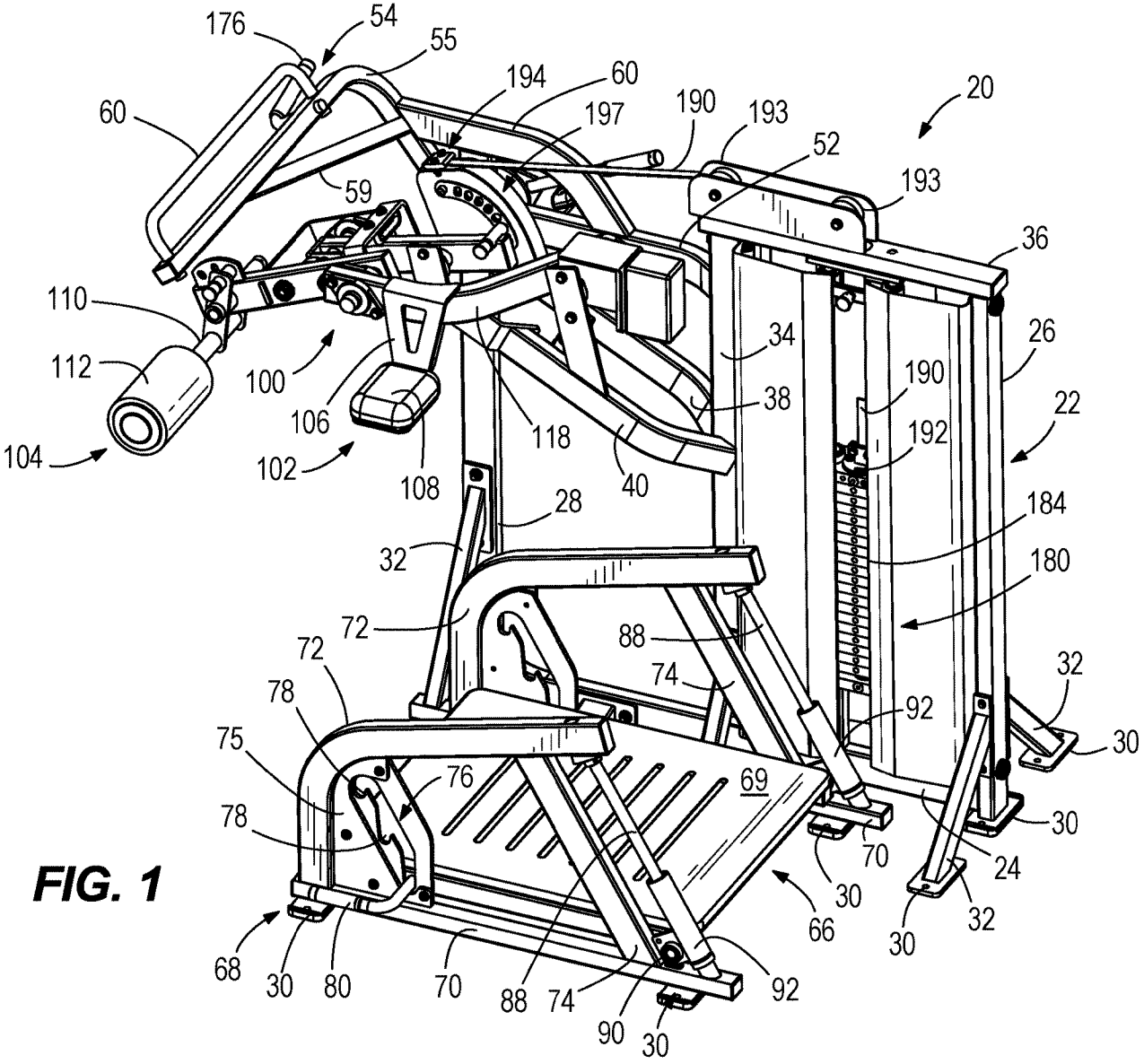
FIG. 1 is a front perspective view of an exercise machine for leg strengthening, particularly enabling a hamstring curl exercise motion.

It should be understood at the outset that, although exemplary embodiments are illustrated in the figures and described below, the principles of the present disclosure may be implemented using any number of techniques, whether currently known or not. The present disclosure should in no way be limited to the exemplary implementations and techniques illustrated in the drawings and described below.

During research and development with exercise equipment, the present inventors identified a frequent occurrence of hamstring injuries in athletes, particularly high performance athletes such as professional soccer players. The present inventors have realized and believe that many of these injuries could have been avoided with improved strength training, and specifically strength training that better simulates the actual motion of a running stride. The present inventors are not aware of any prior art exercise machines for leg training that accomplish this objective. For example, the present inventors are not aware of any prior art that recognizes this issue, and also are not aware of any prior art that facilitates, for example, a contralateral, standing, single leg motion resembling a running stride. The present disclosure is a result of the inventors recognition of this problem, and unique ways to solve the problem, and provides results of the present inventors efforts to provide such strength training.

Figure 2:
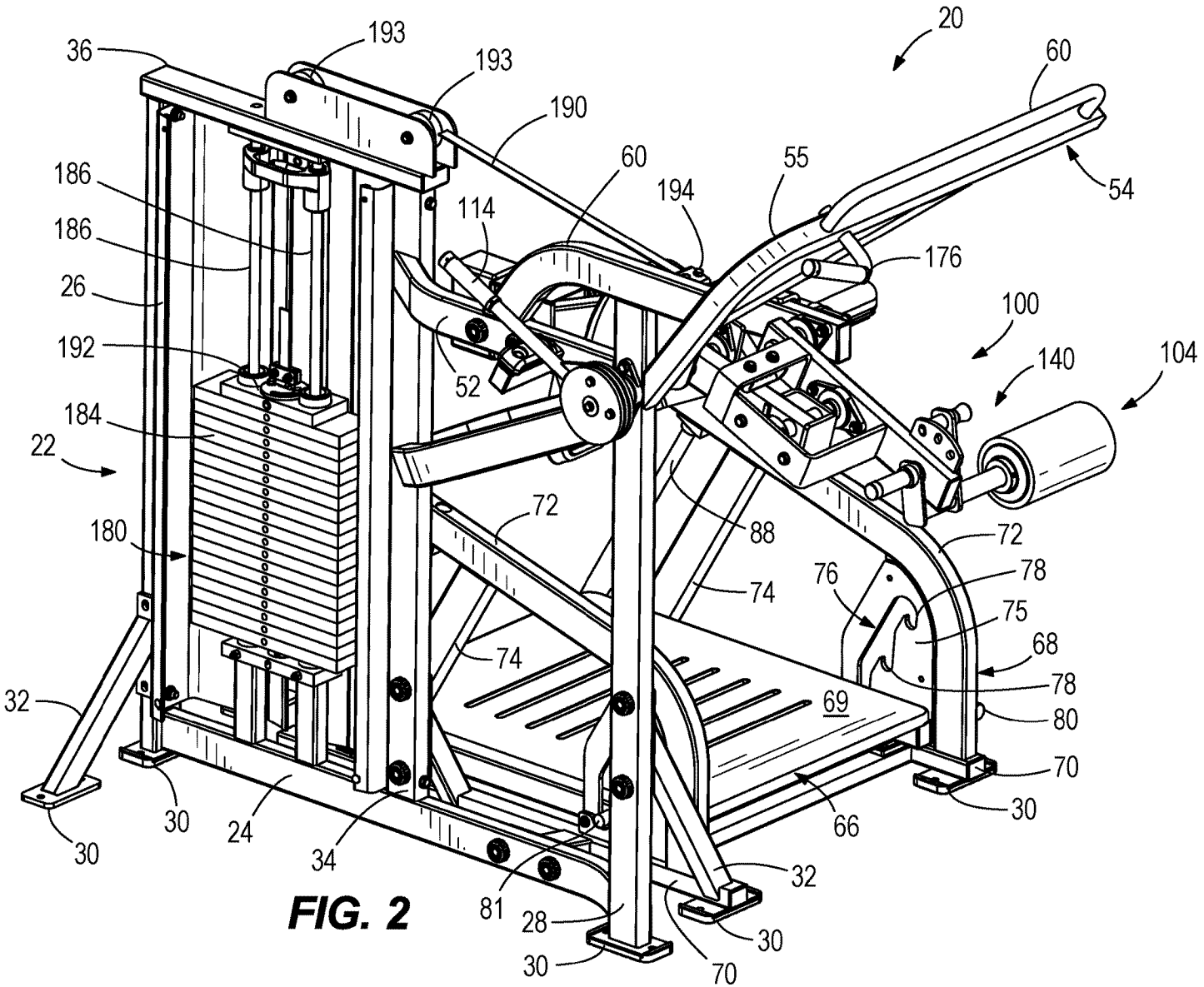
FIG. 2 is a rear perspective view of the exercise machine.
Figure 3:
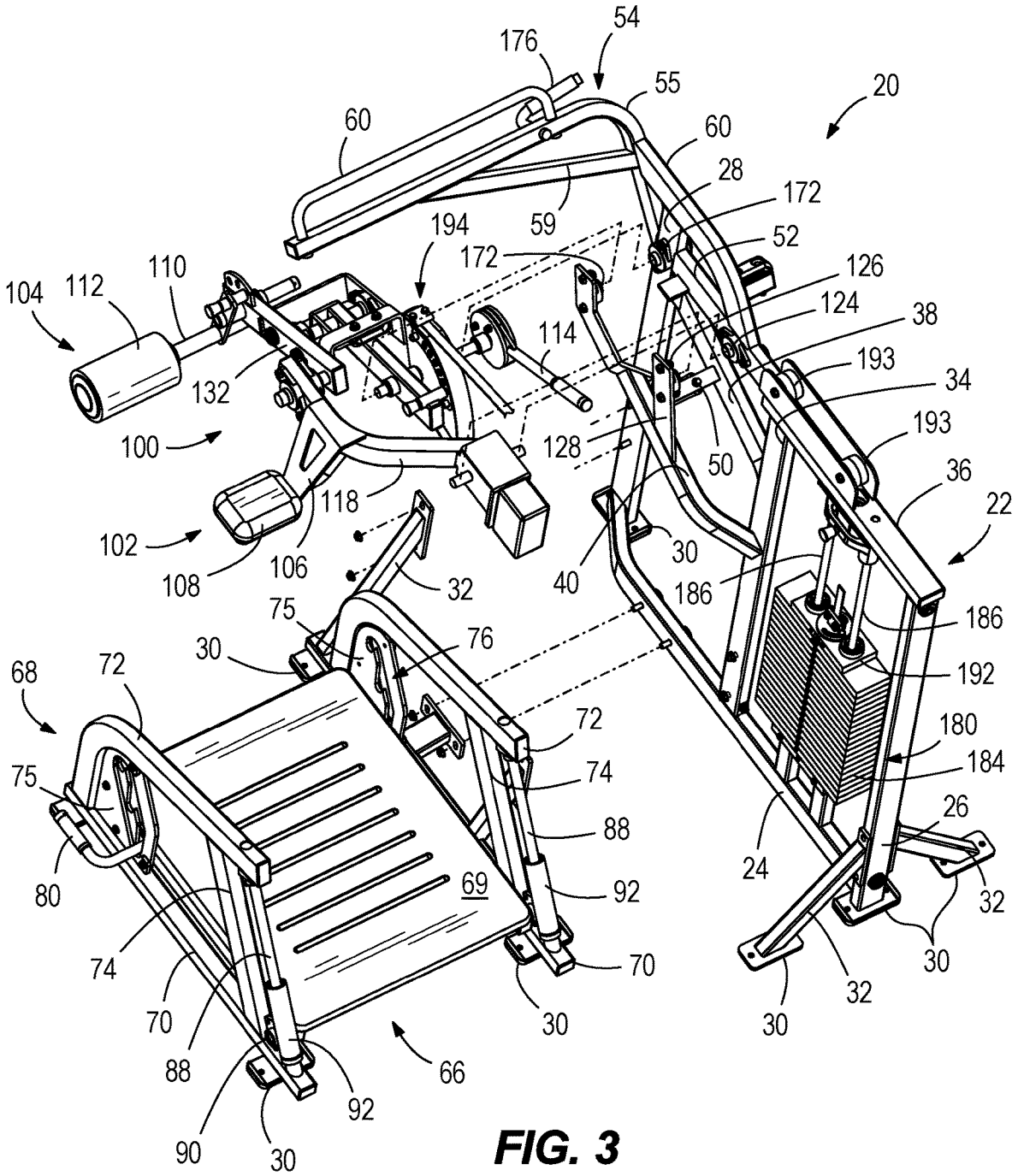
FIG. 3 is an exploded view of the exercise machine.

FIGS. 1-3 depict an exercise machine 20 for leg strengthening. The exercise machine 20 has a stationary frame 22 with a number of rigid frame members that support the exercise machine 20 with respect to a ground surface. The type and configuration of the stationary frame 22 shown in the drawings is merely exemplary and can vary. In the illustrated example, the stationary frame 22 includes a base beam 24 that is raised above and extends generally parallel to the ground surface. The base beam 24 is connected at its rearward and forward ends to generally vertically extending rearward and forward support columns 26, 28. Each of the rearward and forward support columns 26, 28 has a foot pedestal 30 consisting of a generally flat plate that engages the ground surface. The base beam 24 extends between the rearward and forward support columns 26, 28 and is connected thereto at a location slightly above the foot pedestals 30 so that the base beam 24 is spaced from the ground surface. Pairs of angular supporting legs 32 extend transversely downwardly from a lower portion of the rearward and forward support columns 26, 28 and have foot pedestals 30 for engaging the ground surface. The angular supporting legs 32 thus provide lateral support to the stationary frame 22.

An intermediate support column 34 extends generally vertically upwardly from the base beam 24 between the rearward and forward support columns 26, 28. A top beam 36 is connected to the tops of the rearward and intermediate support columns 26, 34. Together, the rearward portion of the base beam 24, the rearward support column 28, the intermediate support column 34 and the top beam 36 define a surrounding frame for supporting portions of a resistance mechanism, which will be further described herein below.

The stationary frame 22 also includes first and second opposing frame arms 38, 40 that extend angularly upwardly from a middle portion of the intermediate support column 34 towards the forward support column 28. The first opposing frame arm 38 is fixed at opposite ends to a side surface of the intermediate support column 34 and a side surface of the forward support column 28. The second opposing frame arm 40 is fixed at its rearward end to a front side surface of the intermediate support column 34. The forward end of the second opposing frame arm 40 is cantilevered from the intermediate support column 34 and is laterally spaced apart from the forward support column 28. A cross brace 50 (FIG. 3) laterally extends between the first and second opposing frame arms 38 and 40 providing rigidity to the assembly. A third frame arm 52 extends between the intermediate support column 34 and the forward support column 28 and is located above the first and second opposing frame arms 38, 40. The third frame arm 52 is fixed at its rearward end to the side surface of the intermediate support column and at its forward end to the rear side surface of the forward support column 28.

A handle frame 54 extends upwardly and laterally from the forward support column 28. The handle frame 54 has a support beam 55 with a first end attached to an upper portion of the forward side surface of the forward support column 28, and a second end that is cantilevered transversely outwardly relative to the forward support column 28, so that the second end extends perpendicularly relative to the forward support column 28. The support beam 55 is generally L-shaped so as to facilitate the perpendicular orientation of the cantilevered second end relative to forward support column 28. A generally L shaped cross-brace 59 has a first end fixed to an intermediate portion of the third frame arm 52 between its opposite ends, and a second end fixed to an intermediate portion of the support beam 55, thus providing rigidity and strength to the cantilevered handle frame 54. An elongated handle bar 60 is fixed to the second end of the support beam 55 for grasping by a user while standing and operating the exercise machine 20, as further described herein below.

Referring to FIGS. 1-3, the exercise machine 20 also has a platform 66 on which the user stands while performing an exercise motion using the exercise machine 20, as will be described further herein below. The platform 66 includes a planar tread member 69 having raised and/or lowered treads for encouraging a secure frictional engagement between the user's feet and the planar tread member 69. The height of the platform 66 above the ground surface is adjustable. The platform 66 thus may be raised and lowered, depending upon the height of the user. In particular, a platform frame 68 supports the platform 66 and facilitates positioning of the platform 66 in a variety of fixed positions with respect to the stationary frame 22. The platform frame 68 has opposed supporting beams 70 that extend parallel to each other and have foot pedestals 30 that engage the ground surface and support the opposed supporting beams 70 above the ground surface. Generally L-shaped support bars 72 are attached at their forward end to the respective opposed supporting beams 70 and extend upwardly and rearwardly above the opposed supporting beams 70. A pair of angular rear supporting columns 74 have lower ends connected to the opposed supporting beams 70 and extend forwardly at an angle. The upper ends of the angular rear supporting columns 74 are fixed to the L-shaped supporting bars 72, thus providing rigidity and support to the platform frame 68.

Positioning plates 75 are located on the sides of opposing forward portions of each of the L-shaped support bars 72, and each has an angled slot 76 with a series of stepped recesses 78 extending from and below the angled slot 76. The number of stepped recesses 78 can vary from what is shown. In the illustrated example, there are three stepped recesses 78, each corresponding to a different fixed height of the platform 66. A lift handle 80 extends from one side of the platform 66 and through the angled slot 76. The lift handle 80 can be manually raised and lowered along the angled slot 76, as shown by comparison of FIGS. 9-11, to adjust the height of the platform 66. In particular, the lift under force of gravity, lift handle 80 is engageable with the platform frame 68 by manually releasing the lift handle 80 so that it becomes seated in one of the stepped recesses 78.

Figure 9:
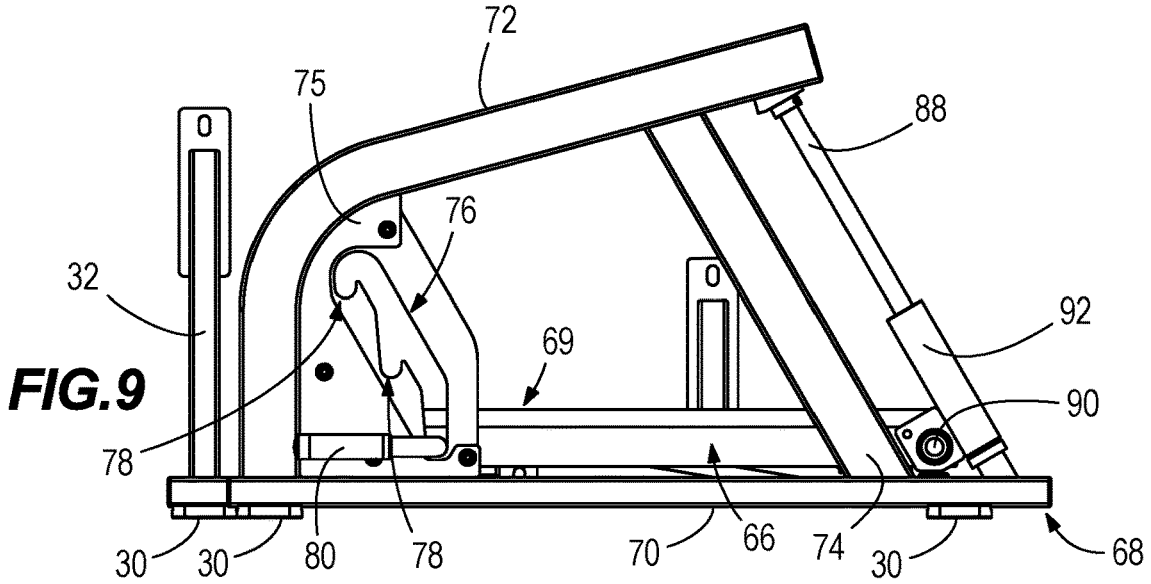
FIG. 9 depicts a platform frame and platform for supporting a user with respect to the exercise machine.
Figure 10:
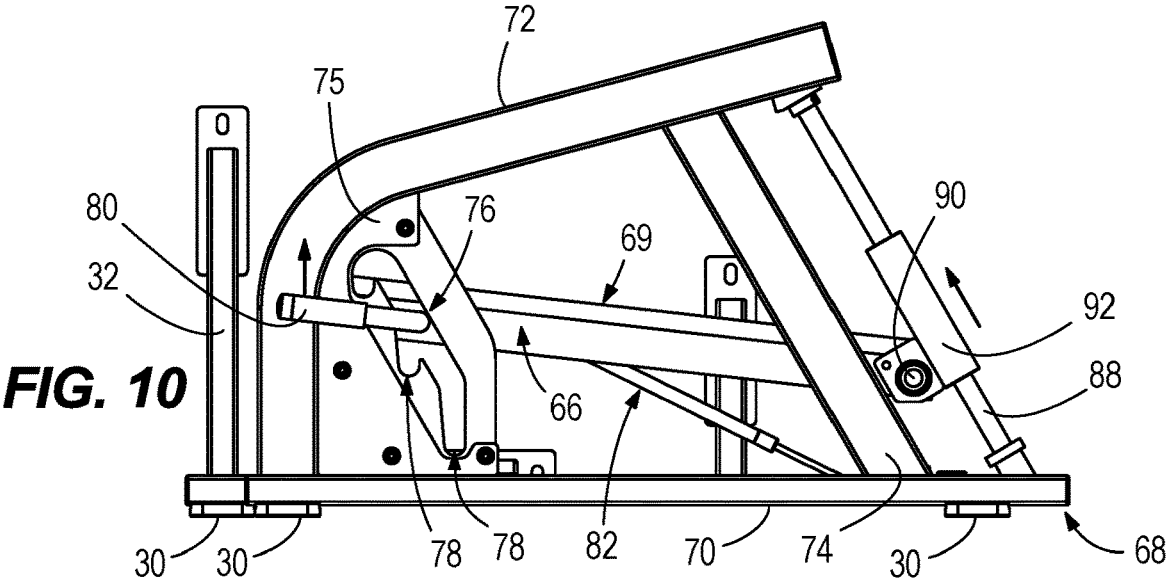
FIG. 10 depicts the platform as it is being raised with respect to the platform frame.
Figure 11:
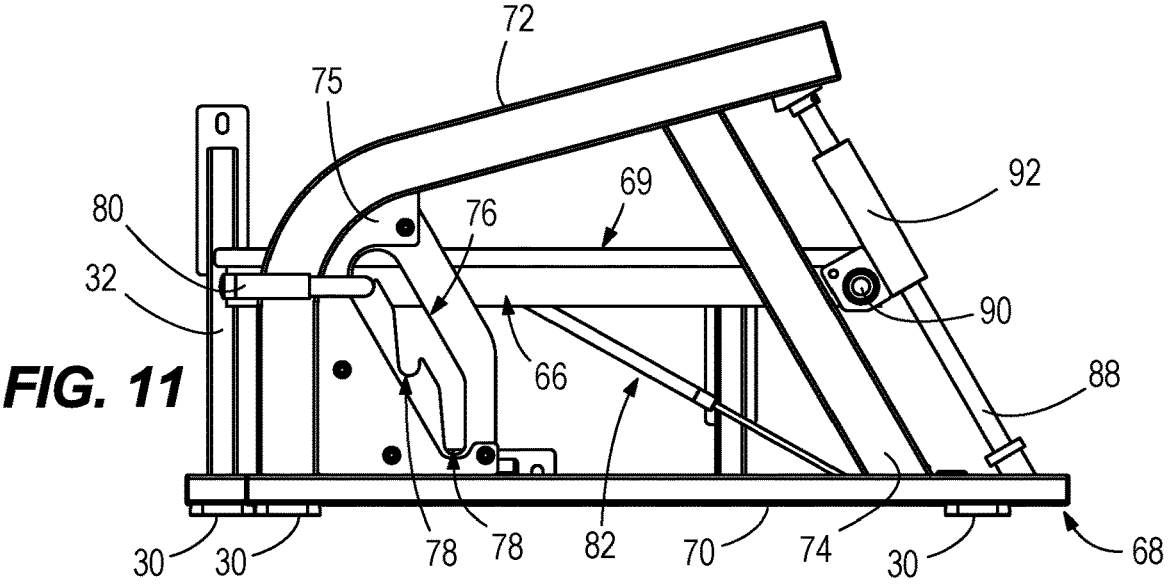
FIG. 11 depicts the platform after it has been raised with respect to the platform frame.

Comparison of FIGS. 9-11 shows a progression of lifting the lift handle 80 from the lowermost stepped recess 78 and moving the lift handle 80 upwardly along the angled slot 76, and then releasing the lift handle 80 so that it becomes seated under force of gravity in the uppermost stepped recess 78. A pin 81 (FIG. 2) extends from the platform 66 into the angled slot on the opposite side of the platform frame 68 relative to the lift handle 80. The pin 81 engages with the stepped recesses on the opposite side, when the lift handle 80 is manually released and seated in the stepped recesses 78 on the side shown in FIGS. 9-11. A gas cylinder 82 is located below the platform 66 and assists movement and positioning of the platform 66 with respect to the platform frame 68. The gas cylinder 82 is transversely oriented with respect to the platform 66 and has a first end coupled to the platform 66 at a pivot point (not shown) and a second end coupled to the platform frame 68 at a pivot point (not shown). The gas cylinder 82 provides an assistance force on the platform 66 to assist the user with lifting the platform 66 via the lift handle 80. The gas cylinder 82 also provides a force on the platform 66 that prevents the platform 66 from free-falling when the lift handle 80 is removed from the stepped recesses 78.

The rear of the platform 66 is pivotably coupled to the platform frame 68. In particular, opposing slide bars 88 are fixed to and angularly extend between the opposed supporting beams 70 and the rear ends of the L-shaped support bars 72. The rear of the platform 66 is pivotably connected by pivot joints 90 to sleeves 92 that slide up and down along the opposing slide bars 88 as the lift handle 80 is raised and lowered along the angled slot 76. The angle of the slide bars 88 allows the sleeves 92 to frictionally engage with and retain the platform 66 with respect to the platform frame 68 when the lift handle 80 is manually released and gravity allows the lift handle 80 to seat in one of the stepped recesses 78, thus retaining the platform 66 in a horizontal position.

Referring now to FIGS. 1-4, the exercise machine 20 has a unique linkage 100 that couples a thigh support member 102 and an ankle support member 104 to the stationary frame 22. The thigh support member 102 is for supporting a user's thigh during a hamstring curl exercise motion, and includes a cantilevered arm 106 that supports a resilient pad 108, having a top surface that is sized and shaped to comfortably support the bottom of a user's thigh. The ankle support member 104 is for supporting the user's ankle during the hamstring curl exercise motion, and includes a cantilevered arm 110 and a resilient pad 112, which is tubular and sized and shaped to comfortably support the bottom of a user's ankle along the lower calf. As described herein below, advantageously, the thigh support member 102 and ankle support member 104 are each movable with respect to the stationary frame 22 during the hamstring curl exercise motion, thus facilitating contraction and extension of both of the user's thigh and ankle. In particular, as described further herein below, contraction and extension of both of the user's hamstring and glute during the hamstring curl exercise motion causes each of the thigh support member 102 and ankle support member 104 to pivot, respectively, with respect to the stationary frame 22.

The type and configuration of the linkage 100 can vary from what is shown. Referring particularly to FIGS. 4-8, the linkage 100 is a four-bar linkage; however other configurations could instead be employed. The linkage 100 is configured such that that contraction and extension of the user's hamstring and glute during the hamstring exercise motion causes the thigh support member 102 to pivot about a rear fixed pivot axis 116, which remains stationary with respect to the stationary frame 22. In particular, the linkage 100 has a rear pivot arm 118 that couples the thigh support member 102 to the stationary frame 22 such that the rear pivot arm 118 and the thigh support member 102 pivot together about the rear fixed pivot axis 116. The rear pivot arm 118 is an elongated member having a rearward end 120 that is coupled to the stationary frame 22 by opposing axle ends 122 that transversely extend from opposite sides of the rearward end 120 of the rear pivot arm 118 and are supported by the stationary frame 22, and particularly (returning to FIG. 3) extending into a bearing 124 supported in an intermediate portion of the first opposing frame arm 38 and extending into a bearing 126 supported in a stanchion 128 extending upwardly from the second opposing frame arm 40. The opposing axle ends 122 thus extend along and define the rear fixed pivot axis 116. The rear pivot arm 118 has a forward end 130 that is parallel to the rearward end 120, and a middle portion 131 that is angular relative to the forward and rearward ends 120, 130. The cantilevered arm 106 of the thigh support member 102 is attached to the forward end 130 of the rear pivot arm 118 and extends transversely outwardly relative to the rear pivot arm 118 into a position for support of the user's thigh.

The linkage 100 also includes a forward pivot arm 132 that couples the ankle support member 104 to the rear pivot arm 118 at a first movable pivot axis 134 (see FIG. 5), which as described further herein below, pivots about the rear fixed pivot axis 116 along with the rear pivot arm 118. The forward pivot arm 132 has a rearward end 136 and a forward end 138. A pivot axle 141 transversely extends from the rearward end 136 into a bearing 143 on the forward end 130 of the rear pivot arm 118. The pivot axle 141 thus extends along and defines the first movable pivot axis 134 and is carried by the rear pivot arm 118 as it pivots with respect to the rear fixed pivot axis 116. The cantilevered arm 110 of the ankle support member 104 is coupled to and extends transversely from the forward end 138 of the forward pivot arm 132, such that the ankle support member 104 extends transversely relative to the forward pivot arm 132 into a position for supporting the user's ankle. The ankle support member 104 is coupled to the forward pivot arm 132 by an ankle support member adjustment device 140 that facilitates adjustment of the ankle support member 104 into and between multiple (a plurality of) fixed positions relative to the forward pivot arm 132. The ankle support member adjustment device 140 includes a fixed plate 142 extending upwardly from the forward end 138 of the forward pivot arm 132 and a spring-loaded pin 144 mounted on a support bracket 146 extending upwardly from the cantilevered arm 110 of the ankle support member 104. The cantilevered arm 110 has a crank arm 148 on its inward end that is rotatably engaged with a pivot axle 149 extending through a boss 150 on the side of the forward end 138 of the forward pivot arm 132. The spring-loaded pin 144 can be selectively engaged with each of multiple (a plurality of) holes 153 to thereby fix the ankle support member 104 into each of the fixed positions relative to the forward pivot arm, thus allowing for adjustment of the ankle position of the user.

The linkage 100 further includes an intermediate pivot arm 152 that couples the forward pivot arm 132 to the stationary frame 22 at a forward fixed pivot axis 154 (see FIG. 5), which remains stationary with respect to the stationary frame 22, and such that, as described further herein below, contraction and extension of the user's hamstring during the hamstring exercise causes the ankle support member 104, forward pivot arm 132, and intermediate pivot arm 152 to pivot about the forward fixed pivot axis 154. The intermediate pivot arm 152 has a forward end 160, a rearward end 162, and an intermediate portion 164 that extends between the forward and rearward ends 160, 162. A pivot axle 170 extends through the intermediate portion 164 via a throughbore 166 and is supported on opposite sides of the intermediate portion 164 with respect to the stationary frame 22 by bearings 172 (see FIG. 3) supported in the forward support column 28 and second opposing frame arm 40. The pivot axle 170 thus extends along and defines the forward fixed pivot axis 154. The intermediate pivot arm 152 is fixed to the pivot axle 170 so that the two components pivot together with respect to the forward fixed pivot axis 154. The rearward end 162 of the intermediate pivot arm 125 extends rearwardly with respect to the forward fixed pivot axis 154.

The first movable pivot axis 134 is located at the forward end 160 of the intermediate pivot arm 152 (and at the rearward end 136 of the forward pivot arm 132, as previously discussed). The intermediate pivot arm 152 is coupled to an intermediate portion 156 of the forward pivot arm 132, between the forward and rearward ends 136, 138, at a second movable pivot axis 158 (see FIG. 5) that is located forwardly of the first movable pivot axis 134 along the forward pivot arm 132. The intermediate pivot arm 152 is coupled to the forward pivot arm 132 by opposing axle ends 167 that extend laterally outwardly from opposite sides of the forward end 160 of intermediate pivot arm 152 and are supported by bearings 168 of a supporting frame 169 on the inward side of the forward pivot arm 132. As such, contraction and extension of the user's hamstring and glute during the hamstring curl exercise causes the second movable pivot axis 158 to pivot about the first movable pivot axis 134 and causes the first movable pivot axis 134 to pivot about the rear fixed pivot axis 116, as will be further described herein below with reference to FIGS. 5-8.

Referring to FIGS. 1 and 2, the exercise machine further includes a resistance mechanism 180 that resists pivoting movement of the thigh support member 102 and ankle support member 104, respectively, during the hamstring curl exercise motion. The type and configuration of the resistance mechanism can vary from what is shown, with suitable examples disclosed in the above-incorporated U.S. Pat. No. 9,604,090. In the illustrated example, the resistance mechanism 180 a weight stack having a number of resistance weights 184 that are supported by slide bars 186 extending between the base beam 24 and top beam 36. A conventional bayonet (not shown) extends into a centerhole through the weight stack and is engageable by a selector pin 188 (FIG. 5) for engaging a particular number of resistance weights 184 with the bayonet. An elongated pulley member 190 has a first end that is attached to the bayonet via a head plate 192. The pulley member 190 is a belt, however in other examples it could be a cable and/or the like. The pulley member 190 is trained around a pair of pulley wheels 193 located on the top beam 36 and has a second end that is coupled to the linkage 100, particularly to a cam plate 194, which will be described further herein below.

Figure 4:
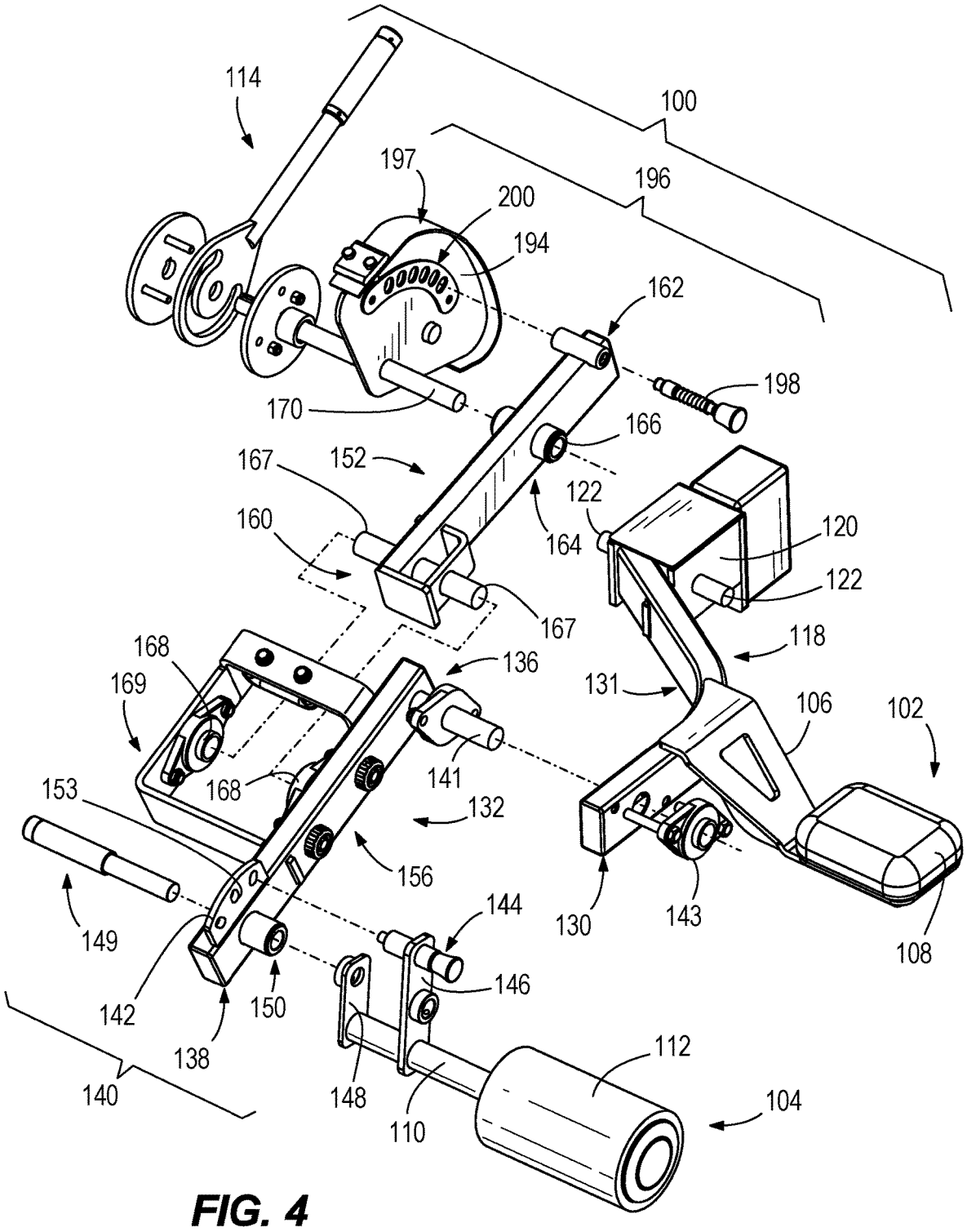
FIG. 4 is an exploded view of a linkage that couples an ankle support member and a hamstring support member to a stationary frame of the exercise machine.

Referring to FIG. 4, the cam plate 194 is fixed to and rotates with the pivot axle 170 with respect to the forward fixed pivot axis 154. The cam plate 194 has a radially outer cam surface 197 with a curved profile along which the pulley member 190 engages when the cam plate 194 is rotated. Thus, as can be seen by comparison of FIGS. 5-8 that pivoting motion of the intermediate pivot arm 152 causes rotation of the pivot axle 170, which in turn causes rotation of the cam plate 194. Rotation of the cam plate 194 in one direction pulls on the pulley member 190, against resistance from the resistance weights selected by the selector pin 188. Rotation of the cam plate 194 in the opposite direction releases the pulley member 190 and is assisted by the resistance weights selected by the selector pin 188. The outer profile of the cam plate 194 can be intentionally contoured to provide a certain resistance profile to the user.

Referring to FIG. 4, a resistance member adjustment device 196 facilitates angular positioning of the intermediate pivot arm 152 about the forward fixed pivot axis 154 with respect to the cam plate 194. In particular, the resistance member adjustment device 196 facilitates user selection of one of multiple (a plurality of) angular positions of the intermediate pivot arm 152 to adjust the start position of the user's ankle and thigh. The resistance member adjustment device 196 includes a spring-loaded pin 198 mounted to the rearward end 162 of the intermediate pivot arm 152, and multiple (a plurality of) holes 200 formed in the cam plate 194. Engagement of the spring-loaded pin 198 in each of the holes 200 fixes the intermediate pivot arm 152 into a different angular position with respect to the cam plate 194, thus affecting the starting position.

Figure 5:
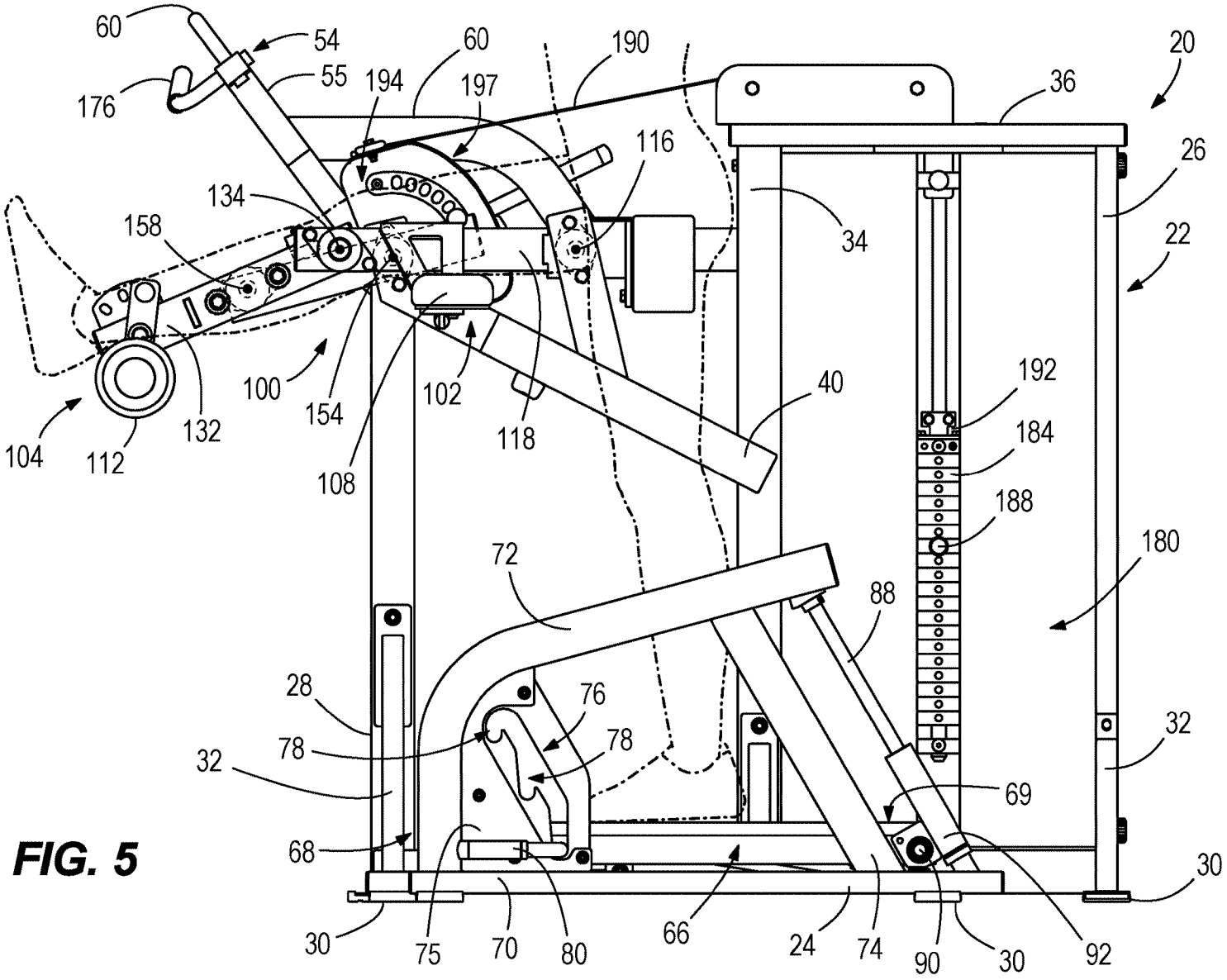
FIG. 5 is a side view of the exercise machine depicting the ankle support member and hamstring support member in a raised position, prior to performance of a hamstring curl exercise motion.

Referring now to FIGS. 5-8, operation of the exercise machine 20 will be further described. As shown in FIG. 5, the user stands on the platform 66 and raises one leg up onto the exercise machine 20 so that the user's thigh 300 rests on the thigh support member 102 and the user's ankle 302 rests on the ankle support member 104. As needed to achieve a comfortable fit, the height of the platform 66 can be adjusted via the lift handle 80, as described herein above with reference to FIGS. 9-11. As needed, the position of the thigh support member 102 can be adjusted via the resistance member adjustment device 196, as described herein above. As needed, the position of the ankle support member 104 can be adjusted via the ankle support member adjustment device 140, as described herein above. FIG. 5 depicts the user in dash-and-dot lines and the exercise machine 20 adjusted to suit the size of the user, as described herein above. Although not shown, referring briefly to FIGS. 1 and 2, the elongated handle bar 60 is positioned above the user's lower body for grasping by the user for added stability.

Figure 6:
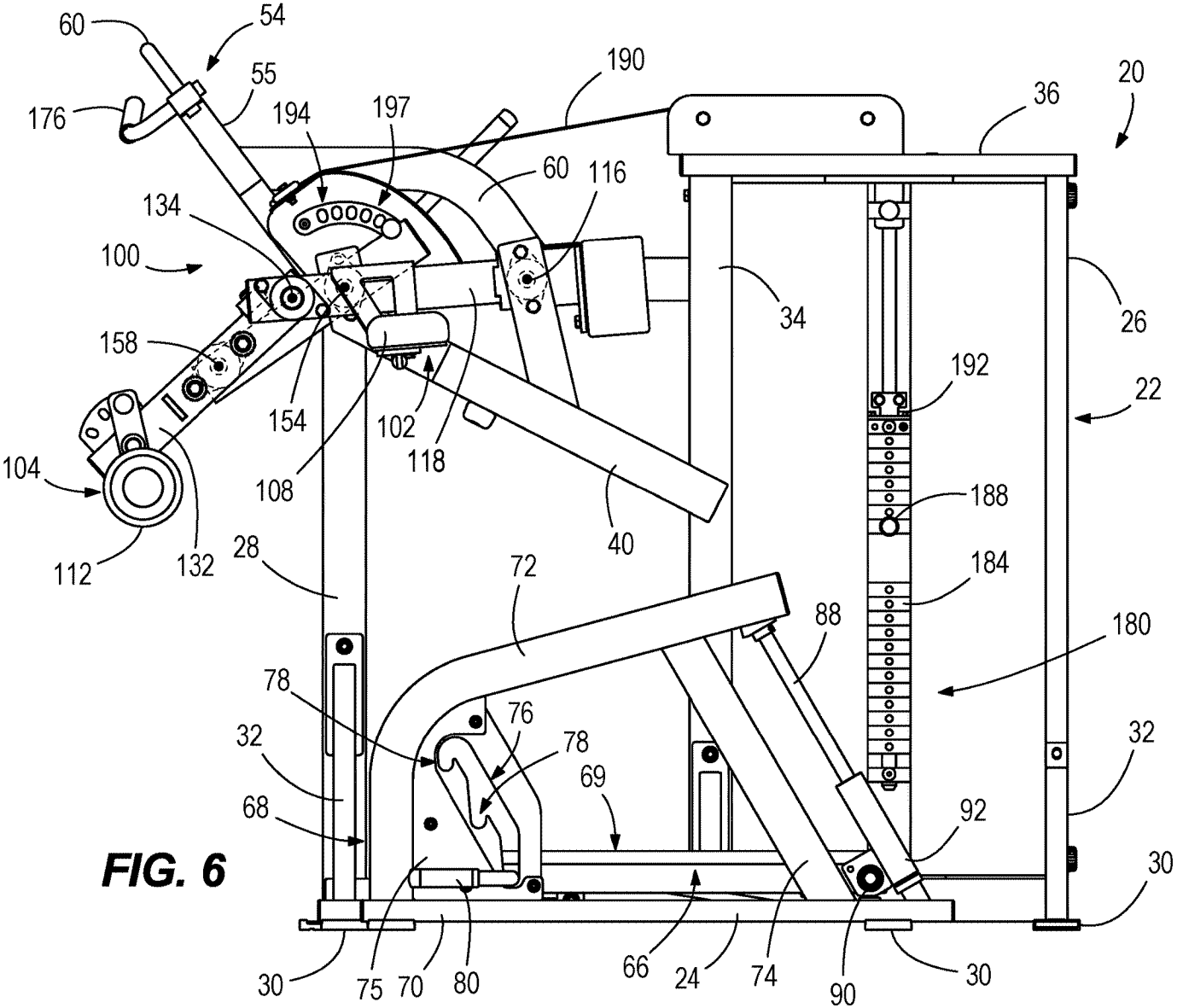
FIG. 6 is a side view of the exercise machine depicting the ankle support member and hamstring support member upon initial contraction of the user's hamstring during the hamstring curl exercise motion.
Figure 7:
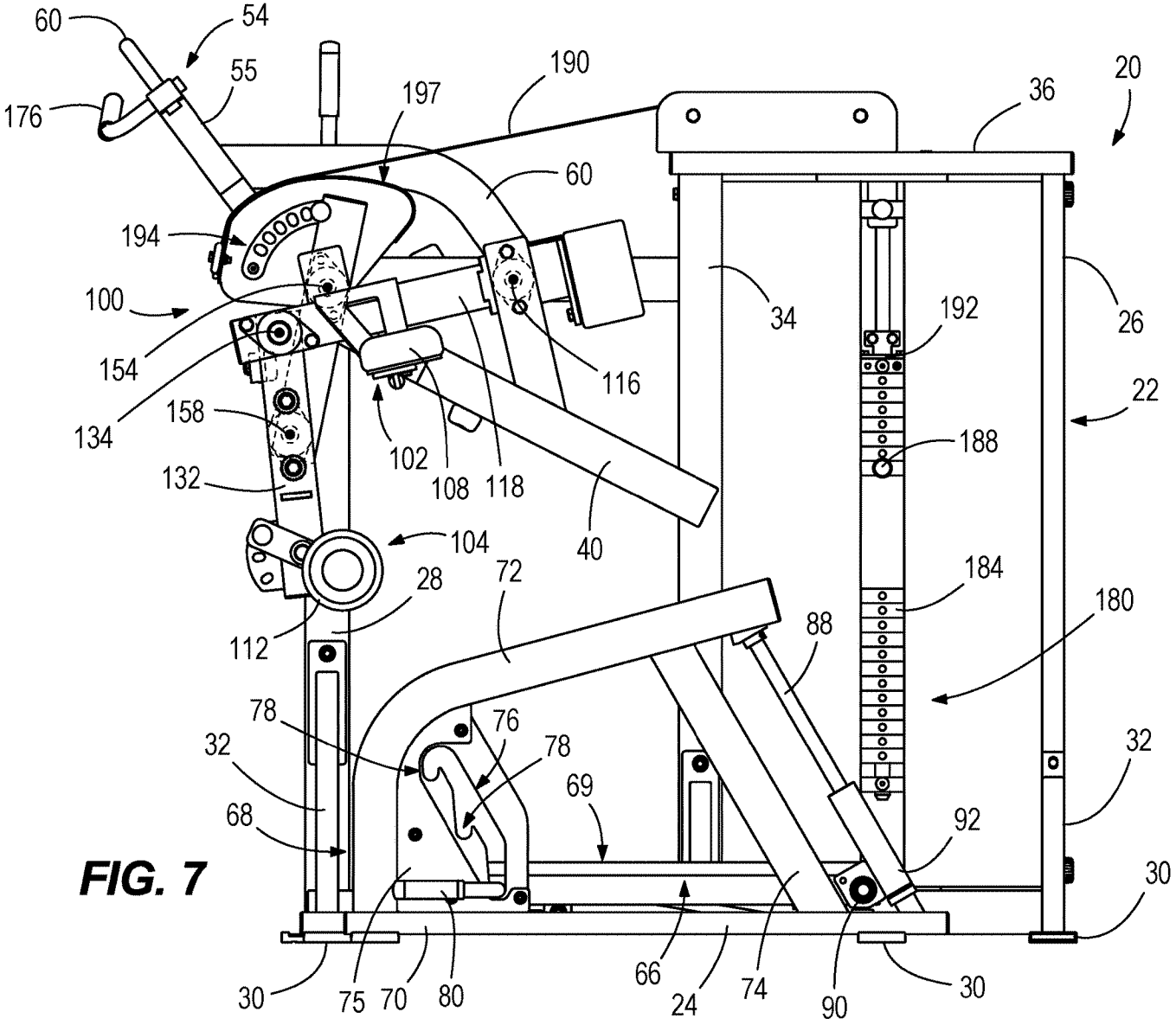
FIG. 7 is a side view of the exercise machine depicting the ankle support member and hamstring support member after initial contraction of the user's hamstring and glute during the hamstring exercise motion.
Figure 8:
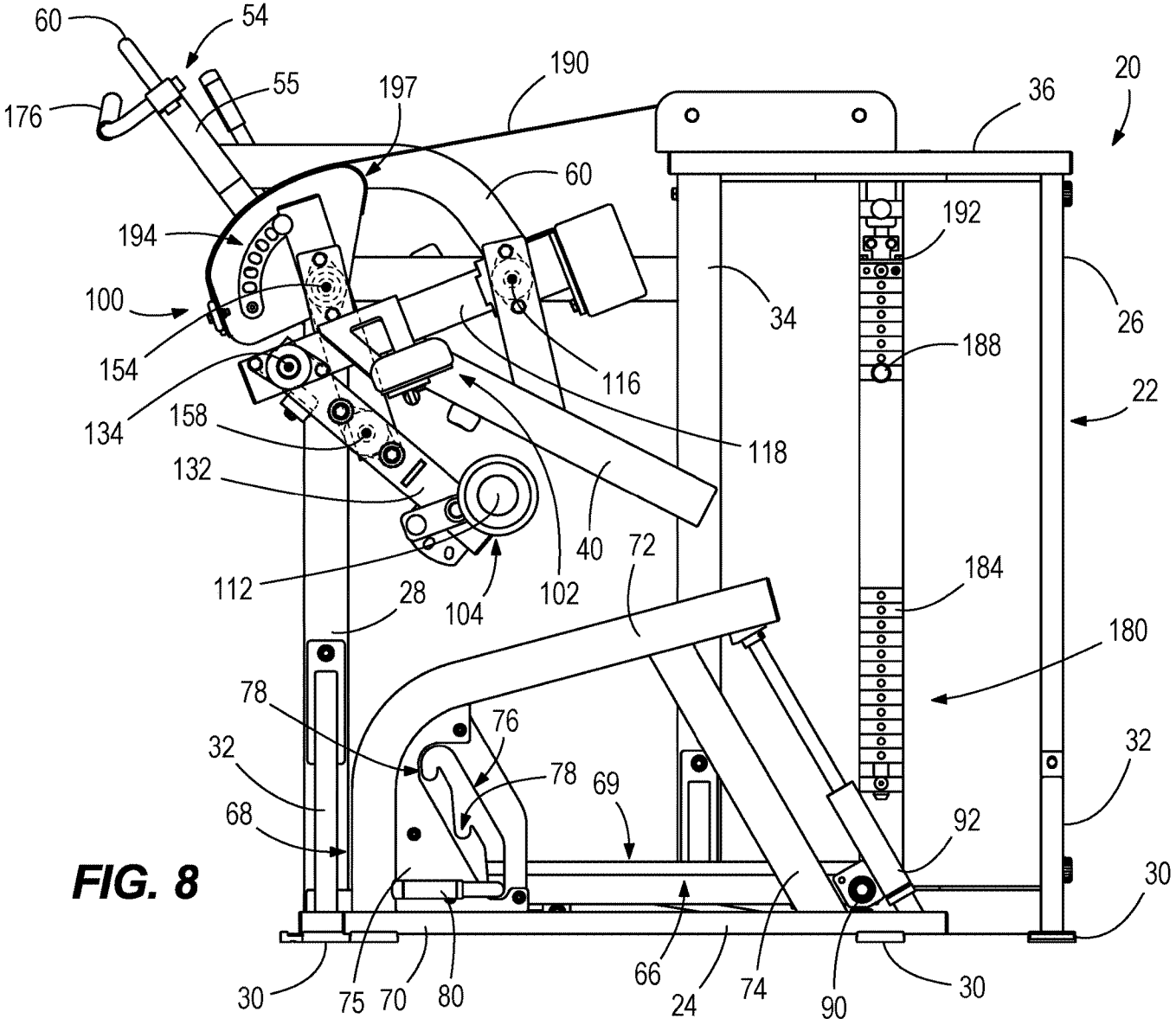
FIG. 8 is a side view of the exercise machine depicting the ankle support member and hamstring support member after contraction of the user's hamstring and glute during the hamstring curl exercise motion.

FIGS. 6-8 sequentially depict exemplary positions of the exercise machine 20 as the user's hamstring and glute is contracted to perform a hamstring curl exercise motion. Comparison of FIGS. 5 and 6 illustrates the initial pivoting movement of the forward pivot arm 132 and intermediate pivot arm 152 as the user's ankle is curled downwardly. The forward pivot arm 132 is caused to pivot downwardly about the first movable pivot axis 134. The intermediate pivot arm 152 is also caused to pivot downwardly about the forward fixed pivot axis 154. This movement is resisted by the resistance mechanism 180, as the cam plate 194 is caused to rotate with the intermediate pivot arm 152 about the forward fixed pivot axis. The pulley member 190 is wrapped onto the outer radius of the cam plate 194 and the selected resistance weights 184 are raised from the remainder of the weight stack 182. The rear pivot arm 118 is also caused to pivot downwardly about the rear fixed pivot axis 116, as shown. The thigh support member 102 thus begins to pivot downwardly along with the rear pivot arm 118. So both the thigh support member 102 and the ankle support member 104 pivot downwardly with respect to the stationary frame 22.

A comparison of FIGS. 6 and 7 illustrates the exercise machine 20 as the user's hamstring and glute are further contracted during the hamstring curl exercise motion. FIG. 7 depicts the ankle support member 104 pivoted downwardly beneath the thigh support member 102. The forward pivot arm 132 is further pivoted about the first movable pivot axis 134 and the intermediate pivot arm 152 is further pivoted about the forward fixed pivot axis 154. The rear pivot arm 118 is further pivoted downwardly about the rear fixed pivot axis 116, and so the thigh support member 102 is further pivoted downwardly.

A comparison of FIGS. 7 and 8 illustrates the exercise machine 20 as the user's hamstring and glute are further contracted during the hamstring curl exercise motion. FIG.

8 depicts the ankle support member 104 pivoted rearwardly of the thigh support member 102, about the first movable pivot axis 134. The rear pivot arm 118 is further pivoted downwardly about the rear fixed pivot axis 116, and so the thigh support member 102 is also further pivoted downwardly.

A comparison of FIGS. 8-5 depicts the exercise machine 20 during subsequent extension of the user's hamstring and glute.

Referring to FIGS. 2 and 4, the linkage 100 further includes a manual assist lever 114 that is coupled to the pivot axle 170 on an opposite side of the stationary frame 22 relative to the rest of the linkage 100. The manual assist lever 114 is configured for a second user to manually assist the hamstring curl exercise motion, for example when the user's strength is depleted, or otherwise to modify the resistance level provided by the resistance mechanism 180. Grasping and rotating the manual assist lever 114 relative to the rear fixed pivot axis 116 rotates the pivot axle 170, which in turn rotates the cam plate 194 relative to the rear fixed pivot axis 116. A fixed assist lever 176 is fixed to the handle frame 54 so that the second user can place the other hand on the fixed assist lever 176 for stability.

The present disclosure thus provides examples of leg exercise machines having features intended for eccentric overload training of a user's leg muscles. In certain examples, the exercise machine advantageously strengthens the muscles involved in a running motion during the exercise. In addition, in certain examples, a handle is provided for a third party to assist the user during the concentric phase of the repetition when the user has exhausted their concentric strength, but still has eccentric strength remaining in the muscle. When exercising the hamstring on prior art exercise machines, the knees are usually the only joint rotating while the hips are fixed. Thus certain examples disclosed herein are improved over the prior art in that they facilitate a compound movement from both the hip and knee joint.

Although specific advantages have been enumerated above, various embodiments may include some, none, or all of the enumerated advantages. Other technical advantages may become readily apparent to one of ordinary skill in the art after review of the following figures and description. Modifications, additions, or omissions may be made to the systems, apparatuses, and methods described herein without departing from the scope of the disclosure. For example, the components of the systems and apparatuses may be integrated or separated. Moreover, the operations of the systems and apparatuses disclosed herein may be performed by more, fewer, or other components and the methods described may include more, fewer, or other steps. Additionally, steps may be performed in any suitable order. As used in this document, "each" refers to each member of a set or each member of a subset of a set.

To aid the Patent Office and any readers of any patent issued on this application in interpreting the claims appended hereto, applicants wish to note that they do not intend any of the appended claims or claim elements to invoke 35 U.S.C. 112(f) unless the words "means for" or "step for" are explicitly used in the particular claim.

What is claimed is:

1. An exercise machine for leg strengthening, the exercise machine comprising:

a stationary frame;

a linkage;

a thigh support member and an ankle support member coupled to the stationary frame by the linkage, and configured to support a user's thigh and ankle, respectively, during a hamstring curl exercise motion;

wherein the linkage is configured such that the thigh support member and the ankle support member are each movable with respect to the stationary frame during the hamstring curl exercise motion, thus facilitating contraction and extension of both of a hamstring and glute of the user during the hamstring curl exercise motion;

wherein the linkage is configured such that contraction and extension of both of the hamstring and glute during the hamstring curl exercise motion causes the ankle support member to pivot relative to the thigh support member, and causes both of the ankle support member and the thigh support member to pivot relative to the stationary frame; and a resistance mechanism coupled to the linkage and configured to resist pivoting movement of the ankle support member relative to the thigh support member and configured to resist pivoting movement of both of the ankle support member and thigh support member relative to the stationary frame.

2. The exercise machine according to claim 1, wherein the linkage couples the thigh support member to the stationary frame such that the contraction and extension of the user's thigh during the hamstring exercise motion causes the thigh support member to pivot about a rear fixed pivot axis, which remains stationary with respect to the stationary frame.

3. The exercise machine according to claim 2, wherein the linkage comprises a rear pivot arm that couples the thigh support member to the stationary frame such that the rear pivot arm and the thigh support member pivot together about the rear fixed pivot axis.

4. The exercise machine according to claim 3, wherein the thigh support member extends transversely from the rear pivot arm.

5. The exercise machine according to claim 3, wherein the linkage comprises a forward pivot arm that couples the ankle support member to the rear pivot arm at a first movable pivot axis, which pivots about the rear fixed pivot axis, along with the rear pivot arm, wherein the contraction and extension of the user's hamstring during the hamstring exercise causes the ankle support member to pivot about the first movable pivot axis.

6. The exercise machine according to claim 5, wherein the ankle support member extends transversely relative to the forward pivot arm.

7. The exercise machine according to claim 6, further comprising an ankle support member adjustment device that facilitates adjustment of the ankle support member into and between a plurality of fixed positions relative to the forward pivot arm.

8. The exercise machine according to claim 7, wherein the ankle support adjustment device comprises a plate on a first one of the forward pivot arm and the ankle support member and a spring-loaded pin on a second one of the forward pivot arm and the ankle support member, and wherein the spring-loaded pin engages with each of a plurality of holes in the plate to thereby fix the ankle support member into a corresponding one of the plurality of fixed positions.

9. The exercise machine according to claim 5, wherein the linkage further comprises an intermediate pivot arm that couples the forward pivot arm to the stationary frame at a forward fixed pivot axis, which remains stationary with respect to the stationary frame, and such that contraction and extension of the user's hamstring during the hamstring exercise causes the ankle support member, the forward pivot arm, and the intermediate pivot arm to pivot about the forward fixed pivot axis.

10. The exercise machine according to claim 9, wherein the intermediate pivot arm is coupled to the forward pivot arm at a second movable pivot axis that is located forwardly of the first movable pivot axis; and wherein contraction and extension of the user's hamstring and glute during the hamstring curl exercise causes the second movable pivot axis to pivot about the first movable pivot axis and causes the first movable pivot axis to pivot about the rear fixed pivot axis.

11. The exercise machine according to claim 10, wherein the intermediate pivot arm has forward and rearward ends and an intermediate portion that extends between the forward and rearward ends, and wherein the first movable pivot axis is located at the forward end of the intermediate pivot arm.

12. The exercise machine according to claim 11, wherein the intermediate pivot arm is coupled to the forward pivot arm by opposing axle ends that transversely extend relative to opposite sides of the intermediate pivot arm and are supported by opposing supporting arms of the forward pivot arm.

13. The exercise machine according to claim 11, further comprising a resistance mechanism that resists pivoting movement of the thigh support member and the ankle support member, respectively, during the hamstring curl exercise motion.

14. The exercise machine according to claim 13, further comprising a manual assist lever fixed to the linkage along the rearward fixed pivot axis, the manual assist lever facilitating another user to manually assist the hamstring curl exercise motion.

15. The exercise machine according to claim 14, wherein the manual assist lever is on an opposite side of the stationary frame relative to the linkage.

16. The exercise machine according to claim 1, wherein the stationary frame is configured for the user to perform the hamstring curl exercise motion in a standing position and further comprising a handle member located above the thigh and the ankle support members.

17. The exercise machine according to claim 1, further comprising a platform on which the user stands while performing the hamstring curl exercise motion.

18. The exercise machine according to claim 17, wherein the platform has a height that is adjustable with respect to the stationary frame.

19. The exercise machine according to claim 18, further comprising a platform frame that supports the platform in a plurality of vertical positions with respect to the stationary frame, and a lift handle on the platform, the lift handle being engage-able with the platform frame to retain the platform in each of the plurality of vertical positions at the plurality of vertical positions.

20. The exercise machine according to claim 19, wherein the lift handle extends from a side of the platform and can be retained in each one of a plurality of stepped recesses formed in the platform frame.

21. The exercise machine according to claim 19, further comprising a gas cylinder that assists movement and positioning of the platform with respect to the platform frame.

22. The exercise machine according to claim 21, wherein the gas cylinder has a first end coupled to the platform and a second end coupled to the platform frame, and wherein the gas cylinder extends transversely to and beneath the platform.

23. An exercise machine for leg strengthening, the exercise machine comprising:

a stationary frame;

a thigh support member and an ankle support member coupled to the frame and configured to support a user's thigh and ankle, respectively, during a hamstring curl exercise motion;

wherein the thigh support member and the ankle support member are each movable with respect to the stationary frame during the hamstring curl exercise motion, thus facilitating contraction and extension of both of a hamstring and glute of the user during the hamstring curl exercise motion; and a linkage that couples the thigh support member to the stationary frame such that the contraction and extension of the user's thigh during the hamstring exercise motion causes the thigh support member to pivot about a rear fixed pivot axis, which remains stationary with respect to the stationary frame;

wherein the linkage comprises a rear pivot arm that couples the thigh support member to the stationary frame such that the rear pivot arm and the thigh support member pivot together about the rear fixed pivot axis; and wherein the rear pivot arm has a rearward end that is coupled to the stationary frame by opposing axle ends that transversely extend relative to opposite sides of the rear pivot arm and are supported by opposing supporting arms of the stationary frame.

24. The exercise machine according to claim 23, wherein the rear pivot arm has a forward end that is parallel to the rearward end, and a middle portion that is angular relative to the forward and rearward ends.

25. An exercise machine for leg strengthening, the exercise machine comprising:

a stationary frame;

a thigh support member and an ankle support member coupled to the frame and configured to support a user's thigh and ankle, respectively, during a hamstring curl exercise motion;

wherein the thigh support member and the ankle support member are each movable with respect to the stationary frame during the hamstring curl exercise motion, thus facilitating contraction and extension of both of a hamstring and glute of the user during the hamstring curl exercise motion;

a linkage that couples the thigh support member to the stationary frame such that the contraction and extension of the user's thigh during the hamstring exercise motion causes the thigh support member to pivot about a rear fixed pivot axis, which remains stationary with respect to the stationary frame;

wherein the linkage comprises a rear pivot arm that couples the thigh support member to the stationary frame such that the rear pivot arm and the thigh support member pivot together about the rear fixed pivot axis;

wherein the linkage comprises a forward pivot arm that couples the ankle support member to the rear pivot arm at a first movable pivot axis, which pivots about the rear fixed pivot axis, along with the rear pivot arm, wherein the contraction and extension of the user's hamstring during the hamstring exercise causes the ankle support member to pivot about the first movable pivot axis;

wherein the linkage further comprises an intermediate pivot arm that couples the forward pivot arm to the stationary frame at a forward fixed pivot axis, which remains stationary with respect to the stationary frame, and such that contraction and extension of the user's hamstring during the hamstring exercise causes the ankle support member, the forward pivot arm, and the intermediate pivot arm to pivot about the forward fixed pivot axis;

wherein the intermediate pivot arm is coupled to the forward pivot arm at a second movable pivot axis that is located forwardly of the first movable pivot axis; and wherein contraction and extension of the user's hamstring and glute during the hamstring curl exercise causes the second movable pivot axis to pivot about the first movable pivot axis and causes the first movable pivot axis to pivot about the rear fixed pivot axis; and wherein the intermediate pivot arm has forward and rearward ends and an intermediate portion that extends between the forward and rearward ends, and wherein the first movable pivot axis is located at the forward end of the intermediate pivot arm; and a resistance mechanism that resists pivoting movement of the thigh support member and the ankle support member, respectively, during the hamstring curl exercise motion;

wherein the resistance mechanism comprises a cam that rotates with the intermediate pivot arm about the second pivot axis.

26. The exercise machine according to claim 25, wherein the resistance mechanism comprises an elongated pulley member having a first end coupled to a resistance weight and a second end coupled to the cam.

27. The exercise machine according to claim 26, wherein the resistance weight is part of a weight stack.

28. The exercise machine according to claim 26, wherein the cam comprises a cam surface having a curved profile along which the elongated pulley member engages as the cam is rotated with the linkage about the second pivot axis.

29. The exercise machine according to claim 26, further comprising a resistance member adjustment device that facilitates positioning of the intermediate pivot arm with respect to the cam into and between a plurality of fixed positions.

30. The exercise machine according to claim 29, wherein the resistance member adjustment device comprises a spring-loaded pin on the intermediate pivot arm and a plurality of holes in the cam, wherein the spring-loaded pin engages with each of a plurality of holes in the cam to thereby fix the intermediate pivot arm into a corresponding one of the plurality of fixed positions.

31. An exercise machine for leg strengthening, the exercise machine comprising:

a stationary frame;

a thigh support member and an ankle support member coupled to the frame and configured to support a user's thigh and ankle, respectively, during a hamstring curl exercise motion;

wherein the thigh support member and the ankle support member are each movable with respect to the stationary frame during the hamstring curl exercise motion, thus facilitating contraction and extension of both of a hamstring and glute of the user during the hamstring curl exercise motion;

a platform on which the user stands while performing the hamstring curl exercise motion, wherein the platform has a height that is adjustable with respect to the stationary frame; and a platform frame that supports the platform in a plurality of vertical positions with respect to the stationary frame, and a lift handle on the platform, the lift handle being engage-able with the platform frame to retain the platform in each of the plurality of vertical positions at the plurality of vertical positions;

wherein the platform frame comprises an angular slide bar on an opposite side of the platform with respect to the lift handle and extending transversely relative to the platform, and further comprising a sleeve that slides along the angular slide bar and facilitates horizontal positioning of the platform upon engagement of the lift handle with the platform frame at one of the vertical positions.

* * * * *